US005875746A

United States Patent [19]

Izuo

[11] Patent Number: 5,875,746

[45] Date of Patent: Mar. 2, 1999

[54] CYLINDER HEAD STRUCTURE FOR AN INTERNAL COMBUSTION ENGINE

[75] Inventor: Takashi Izuo, Toyota, Japan

[73] Assignee: Torota Jidosha Kabushiki Kaisha, Aichi-Ken, Japan

[21] Appl. No.: 47,671

[22] Filed: Mar. 25, 1998

[30] Foreign Application Priority Data

Apr. 2, 1997 [JP] Japan ..... 9-083706

[51] Int. Cl.[6] ..... F01L 9/04; F02F 1/24; F02F 7/00

[52] U.S. Cl. ..... 123/90.11; 123/90.38; 123/193.5

[58] Field of Search ..... 123/90.11, 90.15, 123/90.38, 193.5, 193.3, 195 C, 198 E, 41.01

[56] References Cited

U.S. PATENT DOCUMENTS

| | | | |
|---|---|---|---|
| 4,993,375 | 2/1991 | Akihiko | 123/90.38 |
| 5,003,958 | 4/1991 | Yoneyama et al. | 123/90.38 |
| 5,035,637 | 7/1991 | Mathews- et al. | 123/90.38 |
| 5,161,494 | 11/1992 | Brown, Jr. | 123/90.11 |
| 5,203,830 | 4/1993 | Faletti et al. | 123/90.11 |
| 5,720,242 | 2/1998 | Izuo | 123/90.11 |

FOREIGN PATENT DOCUMENTS

| | | |
|---|---|---|
| 58-101206 | 6/1983 | Japan . |
| 60-175805 | 11/1985 | Japan . |
| 7-12025 | 1/1995 | Japan . |

*Primary Examiner*—Weilun Lo
*Attorney, Agent, or Firm*—Kenyon & Kenyon

[57] ABSTRACT

A cylinder head structure for an internal combustion engine including at least one electromagnetic valve intake or exhaust valve includes an electromagnetic driving apparatus for electromagnetically driving the valve surrounded by a head cover. A power element for supplying driving power to the electromagnetic driving apparatus is disposed on an inner surface of the head cover which is made of a thermally conductive material. The head cover may also be provided with cooling fins and a coolant passage through which coolant flows and a cooling fan for blowing cool air toward the head cover may be disposed on an inner surface of a hood of the vehicle.

8 Claims, 4 Drawing Sheets

CYLINDER HEAD STRUCTURE FOR AN INTERNAL COMBUSTION ENGINE

INCORPORATION BY REFERENCE

The entire disclosure of Japanese Patent Application No. HEI 9-83706 filed on Apr. 2, 1997 including specification, drawings and abstract is incorporated herein by reference in its entirety.

FIELD OF THE INVENTION

The present invention relates to a cylinder head structure for an internal combustion engine and more particularly relates to a cylinder head structure for an internal combustion engine to be mounted on a vehicle wherein at least one of an intake valve and an exhaust valve is an electromagnetic valve.

BACKGROUND OF THE INVENTION

As disclosed in Japanese Patent Laid-Open HEI No. 58-101206, an electromagnetic valve apparatus has been conventionally employed as an intake valve of an internal combustion engine. In this conventional internal combustion engine, the electromagnetic valve apparatus comprises an intake valve for opening and closing an intake port and an electromagnetic driving apparatus for driving the intake valve. The intake valve and the electromagnetic driving apparatus, which constitute the electromagnetic valve apparatus, are both integrated into the internal combustion engine.

The electromagnetic driving apparatus is coupled to a control device disposed outside the engine. At a predetermined timing based on an operating condition of the engine, the control device supplies driving power to the electromagnetic driving apparatus to drive the intake valve between an open position and a closed position thereof. This construction allows the intake valve to be opened or closed at a predetermined timing corresponding to an operating condition of the internal combustion engine.

In this engine, the control device must be equipped with a driver including power elements or switching elements for supplying driving power to the electromagnetic driving apparatus and, in supplying this driving power, the driver generate heat. Also, the driver operate suitably only below a heat resistant temperature thereof. Hence, it is necessary to ensure sufficient cooling capacity where this driver is mounted.

For example, it is known to use a heat sink to cool the driver. In the aforementioned conventional internal combustion engine, the driver can be cooled by a heat sink disposed inside the control device. However, driving the intake valve requires that the electromagnetic valve be supplied with a relatively large driving power. Hence, a comparatively large heat sink must be employed in order to ensure that the driver is sufficiently cooled.

However, it is very difficult to mount a control device containing such a large heat sink on the vehicle. Thus, this engine provides a problem with either the cooling capacity required by the driver or with mounting of the device in the engine.

SUMMARY OF THE INVENTION

It is an object of the present invention to provide a cylinder head structure for an internal combustion engine which exhibits cooling capacity sufficient to maintain driver for driving an electromagnetic valve below a heat resistant temperature thereof and which is easily mounted on a vehicle.

In order to achieve this object, a first aspect of the present invention provides a cylinder head structure of an internal combustion engine including an electromagnetic valve constituting one of an intake valve and an exhaust valve, a head cover surrounding the electromagnetic valve and driver disposed on an inner surface of the head cover for supplying driving power to the electromagnetic valve.

A second aspect of the present invention provides a cylinder head structure for an internal combustion engine including an electromagnetic valve constituting one of an intake valve and an exhaust valve, a head cover surrounding the electromagnetic valve and constituting an inlet air passage and driver disposed on an inner surface of the head cover for supplying driving power to the electromagnetic valve.

In the present invention, the driver for supplying driving power to the electromagnetic valve are disposed on the head cover and the heat generated by the driver is transmitted to the head cover. Thus, the head cover serves as a heat sink for the driver and the head cover of an internal combustion engine has a surface area large enough to sufficiently cool the driver.

According to the second aspect of the present invention, the head cover constitutes the inlet air passage. While the internal combustion engine is in operation, intake air flows into the inlet air passage and the heat generated by the driver is dissipated by the head cover through the intake air flowing therethrough.

In the first and second aspects of the present invention, cooling fins may be disposed on an outer surface of the head cover, increasing a surface area of the head cover and providing increased capacity for cooling the driver.

Further, in the first and second aspects of the present invention, the cylinder head structure may be provided with a cooling fan for blowing cool air toward the outer surface of the head cover so that the heat transmitted from the driver to the head cover is more efficiently dissipated. It is thus possible to obtain increased capacity for dissipating the heat generated by the driver.

Still further, in the first and second aspects of the present invention, a coolant passage may be formed inside the head cover so that, as coolant flows inside the head cover, heat generated by the driver may be dissipated through the coolant. It is thus possible to obtain increased capacity for dissipating the heat generated by the driver.

Still further, in the first aspect of the present invention, the head cover may constitute an inlet air passage. In this case, a space surrounded by the head cover, that is, the space where the driver is disposed constitutes part of the inlet air passage. While the internal combustion engine is in operation, intake air flows into the inlet air passage. The heat generated by the driver is dissipated through the intake air flowing in the vicinity of the driver.

Still further, in the first and second aspects of the present invention, wiring required for operating the electromagnetic valve and the driver may be formed on the head cover. This construction advantageously allows the enhancement of the capacity for dissipating the heat generated by the driver as well as the conservation of the energy required for operating the electromagnetic valve.

Both the wiring for connecting the driver to the electromagnetic valve and the wiring for connecting the driver to a circuit disposed outside the head cover can be disposed on the head cover. In this case, the wiring for connecting the driver to the electromagnetic valve can be shortened. That is, the wiring through which a large current for driving the electromagnetic valve flows can be shortened. This construction reduces a resistance loss that is generated when the driver supplies power to the electromagnetic valve.

BRIEF DESCRIPTION OF THE DRAWINGS

Further objects, features and advantages of the present invention will become apparent from the following description of the preferred embodiments with reference to the accompanying drawings, wherein.

DETAILED DESCRIPTION

Figure 1:
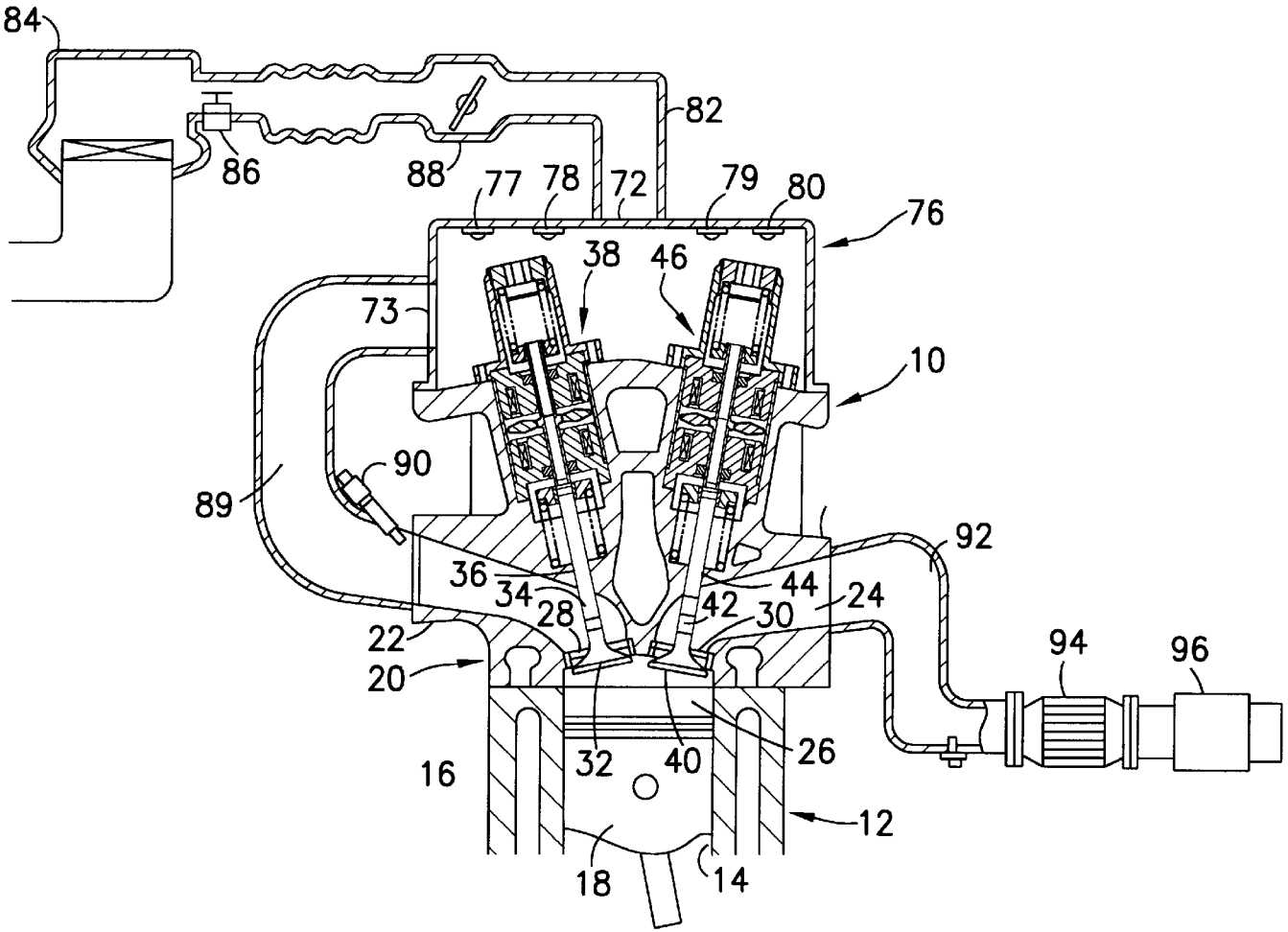
FIG. 1 is a general structural view illustrating an internal combustion engine according to a first embodiment of the present invention.

FIG. 1 is a general structural view illustrating an internal combustion engine 10 according to a first embodiment of the present invention. The internal combustion engine 10 is provided with a cylinder block 12, which has a cylinder 14 and a water jacket 16 formed therein. The internal combustion engine 10 is provided with a plurality of cylinders, one of which is illustrated in FIG. 1 and denoted by reference numeral 14.

A piston 18 is disposed within the cylinder 14. Referring to FIG. 1, the piston 18 is capable of sliding upwards and downwards along an inner wall of the cylinder 14. A cylinder head 20 is secured onto the cylinder block 12. For each of the cylinders, the cylinder head 20 is provided with an intake port 22 and an exhaust port 24. A bottom surface of the cylinder head 20, an upper surface of the piston 18 and a lateral wall of the cylinder 14 define a combustion chamber 26. The aforementioned intake and exhaust ports 22, 24 are both in communication with the combustion chamber 26. Valve seats 28, 30 are formed at respective open end portions of the intake and exhaust ports 22, 24 in the vicinity of the combustion chamber 26 and the cylinder head 20 is provided with an intake valve 32, which moves onto or away from the valve seat 28 to control the degree of communication between the intake port 22 and the combustion chamber 26. A valve shaft 34, which is connected to the intake valve 32, is slidably received within a valve guide 36 formed in the cylinder head 20 and an electromagnetic driving apparatus 38 is coupled to the valve shaft 34 to reciprocate the valve 32 in an axial direction of the valve shaft 34.

In addition, the cylinder head 20 is provided with an exhaust valve 40 which moves onto or away from the valve seat 30 to control the degree of communication between the exhaust port 24 and the combustion chamber 26. A valve shaft 42, which is connected to the exhaust valve 40, is slidably received in a valve guide 44 formed in the cylinder head 20 and an electromagnetic driving apparatus 46 is coupled to the valve shaft 42 to reciprocate the valve 40 in an axial direction of the valve shaft 42.

Figure 2:
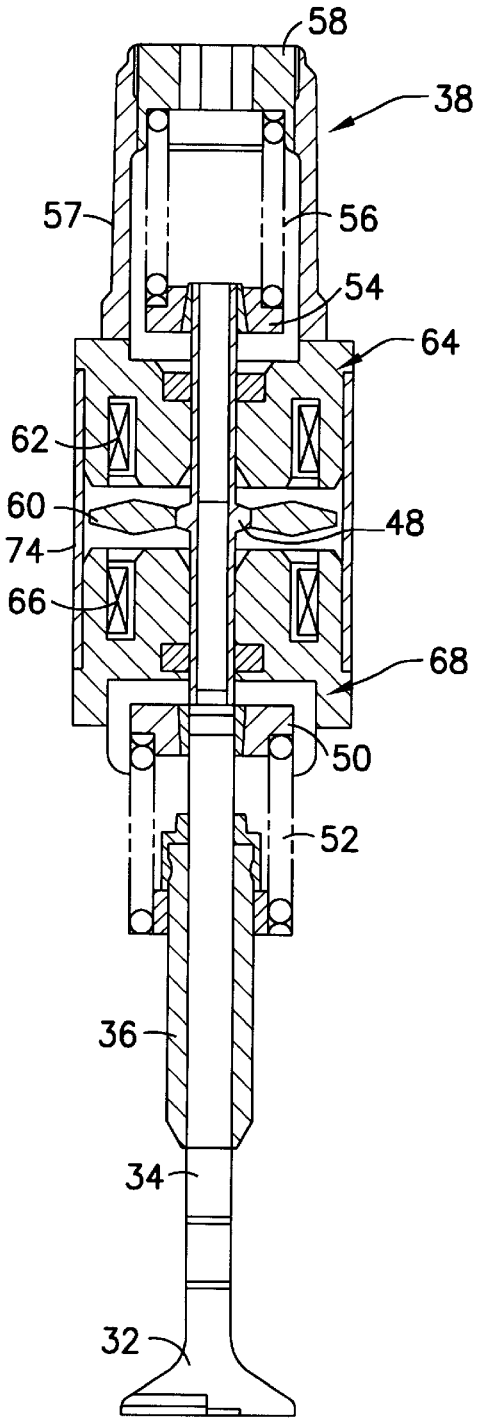
FIG. 2 is a sectional view illustrating the construction of an electromagnetic device employed in the cylinder head structure of the internal combustion engine of FIG. 1.

Because the electromagnetic driving apparatuses 38, 46 are identical in structure, the following description will be made only as to the construction and operation of the electromagnetic driving apparatus 38 with reference to FIG. 2. FIG. 2 is a sectional view illustrating the over all construction of the electromagnetic driving apparatus 38. It is to be noted that like components are denoted by like reference numerals in FIGS. 1 and 2, and that the components illustrated in FIG. 1 will not be described again with reference to FIG. 2.

As illustrated in FIG. 2, the electromagnetic driving apparatus 38 is provided with a plunger holder 48 that is attached to an upper end portion of the valve shaft 34. The plunger holder 48 is made of a non-magnetic material. A lower retainer 50 is attached to a lower end portion of the plunger holder 48. Disposed on a lower surface of the lower retainer 50 is a lower spring 52, whose lower end abuts on the cylinder head 20. Referring to FIG. 2, the lower spring 52 urges the lower retainer 50 and the plunger holder 48 upwards.

An upper retainer 54 is attached to an upper end portion of the plunger holder 48. A lower end portion of an upper spring 56 abuts on an upper surface of the upper retainer 54. The upper spring 56 is surrounded by a cylindrical upper cap 57. Moreover, the upper end portion of the upper spring 56 abuts on an adjusting bolt 58 that is screwed into the upper cap 57. Referring to FIG. 2, the upper spring 56 urges the upper retainer 54 and the plunger holder 48 downwards.

The plunger holder 48 is provided with a plunger 60 around the circumference thereof. The plunger 60 is an annular member made of a soft magnetic material. A first electromagnetic coil 62 and a first core 64 are disposed above the plunger 60, whereas a second electromagnetic coil 66 and a second core 68 are disposed below the plunger 60. The first and second cores 64, 68 are both made of a non-magnetic material. The plunger holder 48 is slidably held by respective central portions of the first and second cores 64, 68.

The first and second cores 64, 68 are surrounded by an outer casing 74. The first and second cores 64, 68 are held by the outer casing 74 such that the first core 64 is spaced apart from the second core 68 by a predetermined distance. The aforementioned upper cap 57 is attached to an upper end surface of the first core 64. The aforementioned adjusting bolt 58 is adjusted such that the plunger 60 assumes its neutral position at a location equally distant from the first and second cores 64, 68. In the electromagnetic driving apparatus 38, when the first and second electromagnetic coils 62, 66 are not supplied with driving power, the plunger 60 assumes its neutral position which is equally distant from the first and second cores 64, 68. If the first electromagnetic coil 62 is supplied with driving power while the plunger 60 assumes its neutral position, there is generated an electromagnetic force that attracts the plunger 60 toward the first core 64.

Referring to FIG. 2, the intake valve 32 moves upwards together with the plunger 60 upon application of the aforementioned electromagnetic force to the plunger 60. The intake valve 32 then moves onto the valve seat 28. It will be presumed hereinafter that when the intake valve 32 is on the valve seat 28, the intake valve 32 is in a closed state and assumes a closed position.

If the driving power supplied to the first electromagnetic coil 62 is interrupted while the intake valve 32 is in the closed position, the electromagnetic force acting on the plunger 60 becomes null. Then, referring to FIG. 1, the plunger 60 moves downwards due to an urging force of the upper spring 56. When the plunger 60 has covered a predetermined distance, the second electromagnetic coil 66 is appropriately supplied with driving power. As a result, an attracting magnetic force is generated which attracts the plunger 60 toward the second core 68. In other words, referring to FIG. 2, the intake valve 32 is urged to move downwards by the magnetic force.

Referring to FIG. 2, the plunger 60 moves downwards together with the intake valve 32 against an urging force of the lower spring 52 upon application of the aforementioned magnetic force to the plunger 60. The intake valve 32 continues to move until the plunger 60 abuts on the second core 68. It will be presumed hereinafter that when the plunger 60 abuts on the second core 68, the intake valve 32 is in a fully open state and assumes an open position.

As described hitherto, the electromagnetic driving apparatus 38 causes the intake valve 32 to move toward the closed position by supplying a predetermined current to the first electromagnetic coil 62, and causes the intake valve 32 to move toward the open position by supplying a predetermined current to the second electromagnetic coil 66. Accordingly, the electromagnetic driving apparatus 38 can reciprocate the intake valve 32 between the open and closed positions by alternately supplying driving power to the first and second electromagnetic coils 62, 66.

In this first embodiment, the electromagnetic driving apparatus 46 for driving the exhaust valve 40 operates in the same manner as the aforementioned electromagnetic driving apparatus 38. Each of the electromagnetic driving apparatuses 38, 46 alternately supplies driving power to the first and second electromagnetic coils 62, 66 at an appropriate timing. Hence, the intake and exhaust valves 32, 40 of the internal combustion engine 10 can operate suitably.

In the internal combustion engine 10 as illustrated in FIG. 1, the cylinder head 20 is covered by a head cover 76, which surrounds upper end portions of the electromagnetic driving apparatuses 38, 46 which are attached to the cylinder head 20. The head cover 76 is preferably made of a thermally conductive material such as AlN (aluminum nitride), copper-type metal, MMC (metal matrix composite) or the like. It is also possible to use resin for the head cover 76.

Power elements 77 through 80 are disposed on an inner surface of the head cover 76 as one of driver. Because the power elements 77 through 80 are disposed inside the head cover 76, they are not exposed to rain water or dust. Each of the power elements 77 through 80 is composed of a bipolar transistor, such as a FET (field effect transistor) or the like, through which a large current can flow. The power elements 77, 78 supply driving power to the first and second electromagnetic coils 62, 66 of the electromagnetic driving apparatus 38 respectively, whereas the power elements 79, 80 supply driving power to the first and second electromagnetic coils 62, 66 of the electromagnetic driving apparatus 46 respectively. Due to the construction wherein the power elements 77 through 80 supply driving power to the electromagnetic driving apparatuses 38, 46 at appropriate timings, the intake and exhaust valves 32, 40 operate suitably. Other elements or circuits of the driver are assumed as switching elements or transistors etc. The power elements are used in this embodiment.

Each of the power elements 77 through 80 has a substrate made of aluminum nitride, which provides excellent insulation. Besides, thermally conductive grease is smeared on the inner surface of the head cover 76 in order to decrease a thermal resistance between the power elements 77 through 80 and the head cover 76. Hence, the heat generated by the power elements 77 through 80 is efficiently transmitted to the head cover 76.

An intake-side opening portion 72 is formed in the head cover 76. The intake-side opening portion 72 is in communication with an intake pipe 82. An air filter 84 is in communication with an end portion of the intake pipe 82 with an air flow meter 86 and a throttle valve 88 disposed downstream of the air filter 84. A branch-pipe-side opening portion 73 is formed in the head cover 76. The branch-pipe-side opening portion 73 is in communication with an intake branch pipe 89. The intake port 22 is in communication with the other end of the intake branch pipe 89. The intake branch pipe 89 is provided with an injector 90 that injects fuel toward the intake port 22.

As described above, the intake branch pipe 89, which leads to the respective cylinders of the internal combustion engine 10, is in communication with the intake pipe 82 via a space defined by the head cover 76 and the cylinder head 20. In this construction, the space defined by the head cover 76 and the cylinder head 20 serves as a surge tank for reducing pulsation of intake air and constitutes part of an intake air passage. The exhaust port 24 of the internal combustion engine 10 is in communication with an exhaust gas passage 92. The exhaust gas passage 92 is connected to a muffler 96 via a catalytic converter system 94. The exhaust gas exhausted from the internal combustion engine 10 is cleansed by the catalytic converter system 94, silenced by the muffler 96 and dissipated into the atmosphere.

As described above, due to the construction wherein the power elements 77 through 80 supply driving power to the electromagnetic driving apparatuses 38, 46, the intake and exhaust valves 32, 40 operate suitably. In supplying driving power to the electromagnetic driving apparatuses 38, 46, the power elements 77 through 80 generate a considerably high heat and the power elements 77 through 80 operate suitably only below a heat resistant temperature thereof.

Hence, in order to operate the internal combustion engine 10 suitably, the heat generated by the power elements 77 through 80 must be dissipated efficiently and the internal combustion engine 10 of this embodiment is characterized by its excellent capacity for dissipating the heat generated by the power elements 77 through 80 so that the power elements 77 through 80 remain below the heat resistant temperature. Hereinafter, the characteristic part of the internal combustion engine 10 will be described with reference to FIG. 3.

Figure 3:
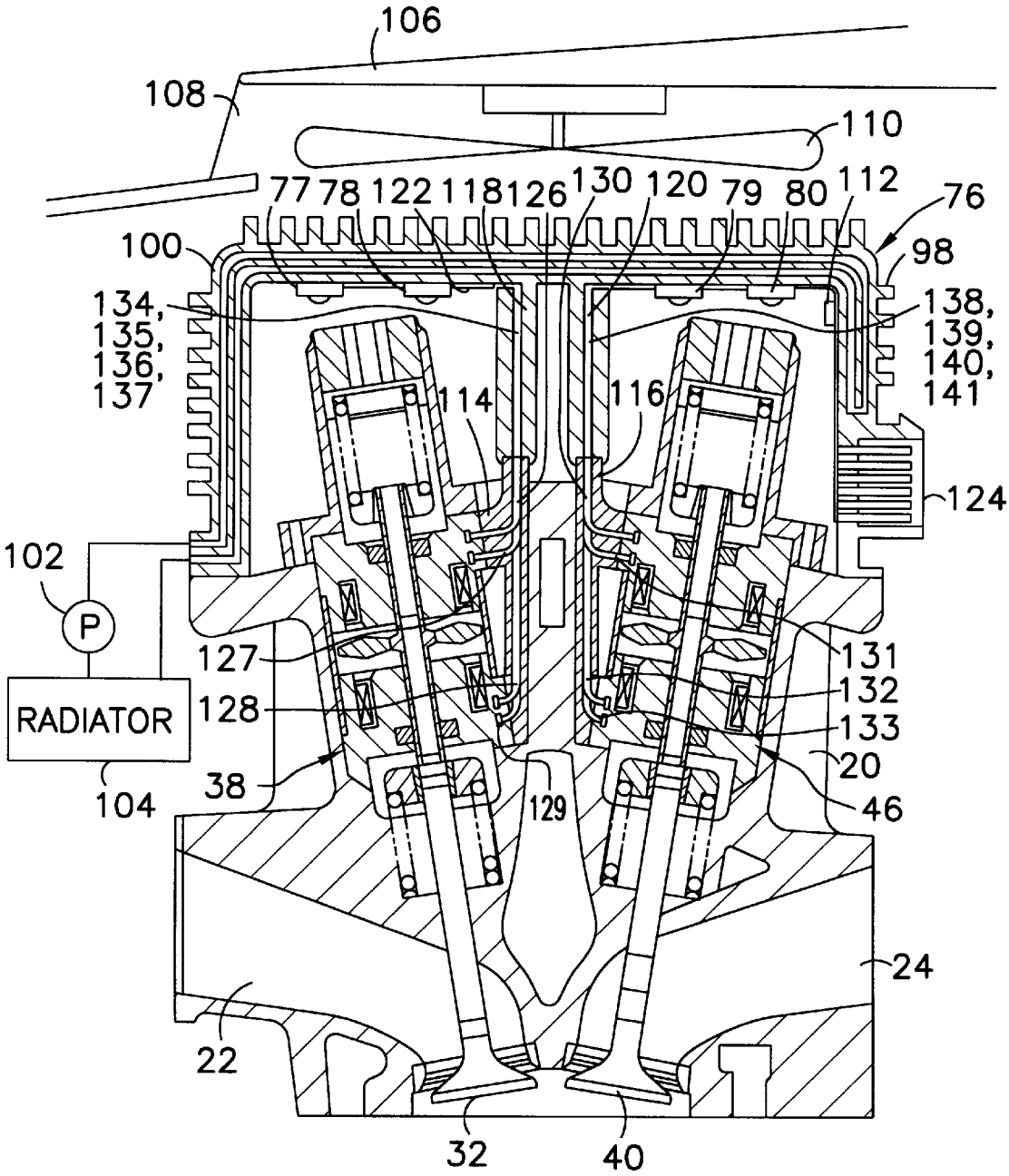
FIG. 3 is an enlarged view illustrating components in the vicinity of a head cover of the internal combustion engine according to a second embodiment of the present invention.

FIG. 3 is an enlarged view illustrating the components in the vicinity of the head cover 76 of the internal combustion engine 10. It is to be noted that like components are denoted by like reference numerals in FIGS. 1, 3, and components illustrated in FIG. 1 will not be described again in regard to FIG. 3. As described above, because the power elements 77 through 80 are disposed on the inner surface of the head cover 76, the heat generated by the power elements 77 through 80 is transmitted to the head cover 76 efficiently. As illustrated in FIG. 3, a plurality of cooling fins 98 are formed on the head cover 76 to provide the head cover 76 with a larger surface area. Hence, the heat transmitted from the power elements 77 through 80 to the head cover 76 can be dissipated to the outside more efficiently.

Figure 4:
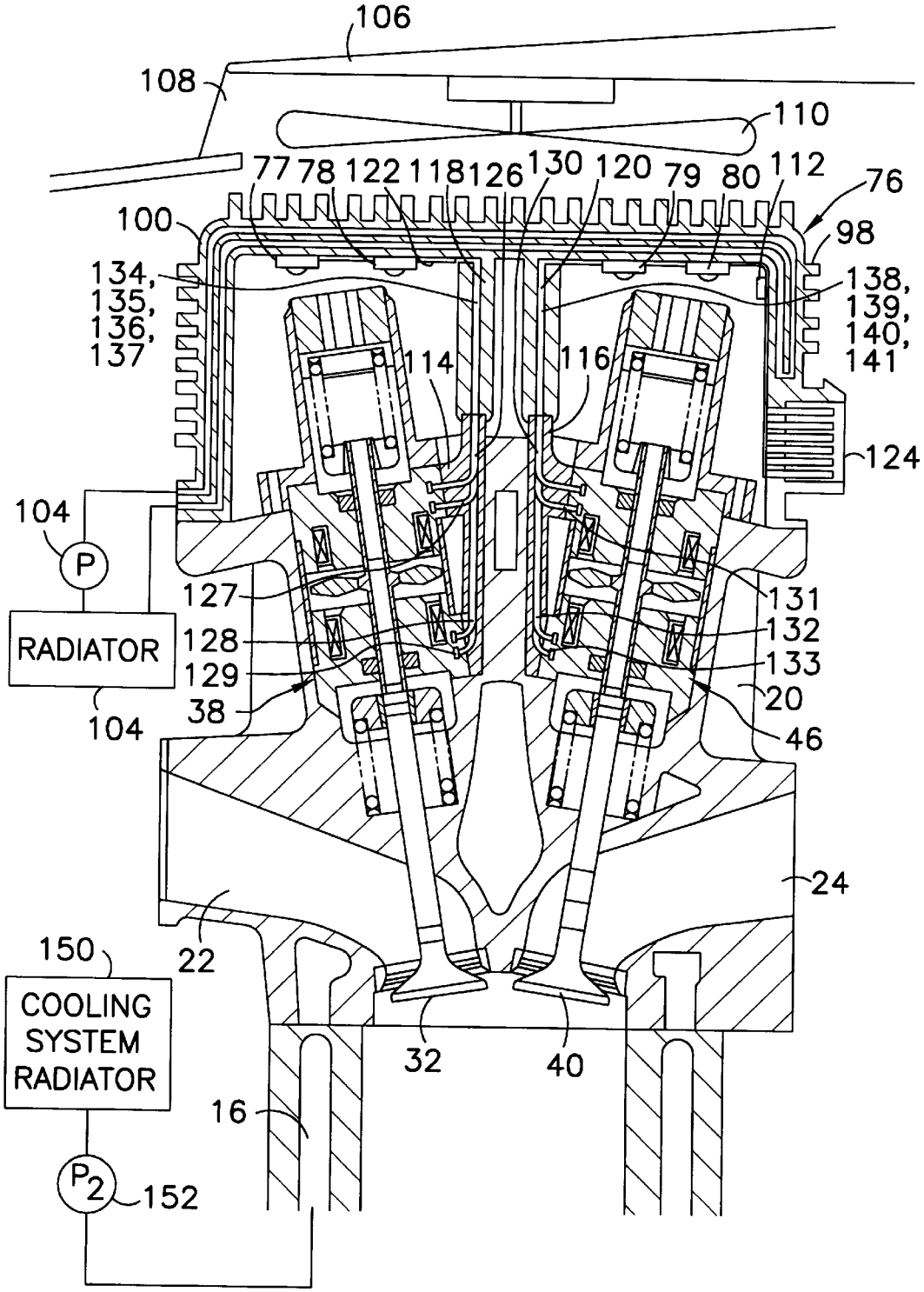
FIG. 4 is an enlarged view illustrating components in the vicinity of the head cover of the internal combustion engine of FIG. 3 showing elements of the engine cooling system.

As illustrated in FIG. 3, a coolant passage 100 formed inside the head cover 76 is in communication with a radiator 104 and a pump 102. The pump 102 and the radiator 104 are preferably provided separately from a cooling system of the internal combustion engine 10, that is, the cooling system including the water jacket 16, a cooling system radiator 150 and a cooling system pump 152, as shown in FIG. 4. The radiator 104 is capable of maintaining the coolant flowing through the coolant passage 100 at a temperature (for example, 60° C.) that is well below the heat resistant temperature of the power elements 77 through 80.

In the case where coolant at a low temperature flows through the coolant passage 100, heat generated by the power elements 77 through 80 can be dissipated through the coolant as well as to the atmosphere surrounding the head cover 76. Hence, the internal combustion engine 10 is capable of efficiently dissipating to the outside heat transmitted from the power elements 77 through 80 to the head cover 76.

As illustrated in FIG. 3, a hood 106 extends over the internal combustion engine 10. The hood 106 is provided with an air intake portion 108, which is designed to channel air which flows into the air intake portion 108 during a running state of the vehicle to the head cover 76. Hence, the internal combustion engine 10 is capable of dissipating the heat transmitted from the power elements 77 through 80 to the head cover 76 efficiently to the outside.

As illustrated in FIG. 3, a cooling fan 110 is also disposed on an inner surface of the hood 106 and a temperature sensor 112, coupled to a controller for the fan 110, is disposed on an inner surface of the head cover 76. The temperature sensor 112 outputs an electric signal corresponding to a temperature of the space surrounded by the head cover 76. Thus, when the signal output from the temperature sensor 112 indicates that the temperature of the space surrounded by the head cover 76 is approaching the heat resistant temperature of the power elements 77 through 80, the cooling fan 110 blows cool air toward the head cover 76. Due to the construction wherein the cooling fan 110 blows cool air toward the head cover 76, the head cover 76 exhibits an enhanced heat dissipating capacity, thus preventing the temperature of the power elements 77 from being raised to the heat resistant temperature.

As described above, the space defined by the head cover 76 and the cylinder head 20 serves as a surge tank in the inlet air passage. Accordingly, intake air flows through the space surrounded by the head cover 76 while the internal combustion engine 10 is in operation and heat generated by the power elements 77 through 80 can be dissipated through the intake air that flowing through the space surrounded by the head cover 76. Hence, the internal combustion engine 10 exhibits excellent capacity for dissipating the heat generated by the power elements 77 through 80.

As described above, the internal combustion engine 10 exhibits excellent capacity for dissipating heat generated by the power elements 77 through 80 which supply driving power to the electromagnetic driving apparatuses 38, 46. The capacity for cooling the power elements 77 through 80 can also be ensured without taking up the additional space necessary to accommodate a heat sink with a surface area sufficiently large to sufficiently cool the power elements 77 through 80. On the contrary, the construction of this embodiment wherein the head cover 76 is used as a heat sink ensures sufficient cooling capacity without adversely affecting the mountability of peripheral circuits including the power elements 77 through 80.

As illustrated in FIG. 3, the electromagnetic driving apparatuses 38, 46 are provided with connectors 114, 116 respectively. The connector 114 holds therein terminals 126 through 129 that are connected to the first and second electromagnetic coils 62, 66 of the electromagnetic driving apparatus 38, whereas the connector 116 holds therein terminals 130 through 133 that are connected to the first and second electromagnetic coils 62, 66 of the electromagnetic driving apparatus 46.

The head cover 76 is provided with fitting portions 118, 120 to which the connectors 114, 116 are fitted respectively. The fitting portions 118, 120 hold therein terminals 134 through 137 and terminals 138 through 141 that are electrically connected to the terminals 126 through 129 of the connector 114 and the terminals 130 through 133 of the connector 116 respectively.

A wire 122 is disposed on the inner surface of the head cover 76. Moreover, the head cover 76 is provided with a centralized connector 124. The wire 122 electrically connects (1)the terminals 134, 135 to the power element 77, (2)the terminals 136, 137 to the power element 78, (3)the terminals 138, 139 to the power element 79 and (4)the terminals 140, 141 to the power element 80 respectively. Also, the wire 122 electrically connects the power elements 77 through 80 to the centralized connector 124. Although FIG. 3 shows terminals 134–137 as one line, those skilled in the art will understand that, in practice, these four terminals may be arranged side-by-side in a plane extending substantially perpendicular to the cross-sectional plane of FIG. 3. Similarly, FIG. 3 shows terminals 138–141 as a single line although these four terminals may also be arranged side-by-side in a plane substantially perpendicular to that of FIG. 3.

In the internal combustion engine 10, the power elements 77 through 80 can be connected to the electromagnetic driving apparatuses 38, 46 by mounting the head cover 76 on the cylinder head 20 appropriately. In this case, all the contacts required for driving the electromagnetic driving apparatuses 38, 46 can be gathered into the centralized connector 124. Hence, the construction of this embodiment allows the internal combustion engine 10 to be assembled easily.

Further, in the internal combustion engine 10, the power elements 77 through 80 are disposed on the inner surface of the head cover 76. Therefore, wiring connecting the power elements 77 through 80 to the electromagnetic driving apparatuses 38, 46 can be shortened. It is necessary to cause a relatively large current to flow through this wiring. In this case, the circuit through which a relatively large current flows can be electrically shielded by the head cover 76.

Because the wiring requiring a relatively large current can be shortened, it is also possible to reduce a resistance loss caused by the flow of the current. Further, because the circuit through which a relatively large current flows can be electrically shielded, it is possible to prevent an electromagnetic wave generated by the flow of the current from affecting other electronic components arranged outside. Hence, the internal combustion engine 10 is capable of operating the intake and exhaust valves 32, 40 with low electrical power consumption without affecting other electronic components.

While the present invention has been described with reference to what are presently considered to be preferred embodiments thereof, it is to be understood that the invention is not limited to the disclosed embodiments or constructions. On the contrary, the invention is intended to cover various modifications and equivalent arrangements included within the spirit and scope of the appended claims.

What is claimed is:

1. A cylinder head structure for an internal combustion engine, comprising:

an electromagnetic valve constituting one of an intake valve and an exhaust valve;

a head cover surrounding the electromagnetic valve so that an inner surface of the head cover faces the electromagnetic valve; and driver for supplying driving power to the electromagnetic valve, wherein the driver is disposed on the inner surface of the head cover.

2. A cylinder head structure for an internal combustion engine including an inlet air passage for supplying intake air to a combustion chamber of the engine, comprising:

an electromagnetic valve constituting one of an intake valve and an exhaust valve;

a head cover surrounding the electromagnetic valve so that an inner surface of the head cover faces the electromagnetic valve, wherein the head cover forms at least a portion of the inlet air passage; and driver for supplying driving power to the electromagnetic valve, wherein the driver is disposed on the inner surface of the head cover.

3. The cylinder head structure according to claim 1, wherein the head cover includes a plurality of cooling fins formed on an outer surface thereof.

4. The cylinder head structure according to claim 1, further comprising a cooling fan for blowing cool air toward the outer surface of the head cover.

5. The cylinder head structure according to claim 1, wherein a first coolant passage extends through at least a portion of the head cover between the inner surface and an outer surface thereof.

6. The cylinder head structure according to claim 1, wherein an inner space defined by the inner surface of the head cover communicates with an inlet air passage of the engine so that intake air passes through the inner space.

7. The cylinder head structure according to claim 1, wherein wiring required for operating the electromagnetic valve and the driver extends along one of the inner and an outer surface of the head cover.

8. The cylinder head structure according to claim 5, further comprising:

a first radiator for dissipating heat from a cooling fluid flowing therethrough, wherein the first radiator is in fluid communication with the first coolant passage;

a first pump for pumping liquid through the first radiator and the first coolant passage;

a second coolant passage extending through an engine block of the engine for cooling the engine block;

a second radiator for dissipating heat from a cooling fluid flowing therethrough, wherein the second radiator is in fluid communication with the second coolant passage; and a second pump for pumping liquid through the second radiator and the second coolant passage.

* * * * *

UNITED STATES PATENT AND TRADEMARK OFFICE

CERTIFICATE OF CORRECTION

PATENT NO. : 5,875,746

DATED : March 2, 1999

INVENTOR(S) : Takashi IZUO

It is certified that error appears in the above-identified patent and that said Letters Patent is hereby corrected as shown below:

On the title page item [73], change "Torota Jidosha Kabushiki Kaisha" to -- Toyota Jidosha Kabushiki Kaisha--.

Signed and Sealed this

Twenty-ninth Day of February, 2000

*Attest:*

Q. TODD DICKINSON

*Attesting Officer*

*Commissioner of Patents and Trademarks*